US005908132A

United States Patent [19]

Pigeon

[11] Patent Number: 5,908,132

[45] Date of Patent: Jun. 1, 1999

[54] TRASH RECEPTACLE WITH ADVERTISEMENT DISPLAY

[76] Inventor: Franck Pigeon, 1717 N. Bayshore Dr. Ste. 2246, Miami, Fla. 33132

[21] Appl. No.: 08/820,974

[22] Filed: Mar. 19, 1997

[51] Int. Cl.[6] ..... B65D 25/18

[52] U.S. Cl. ..... 220/484; 220/908.1; 220/636; 206/315.3

[58] Field of Search ..... 206/315.5, 315.3; 220/908, 475, 484, 23.87, 23.89, 23.91, DIG. 6, 918, 921, 908.1, 676, 628, 636

[56] References Cited

U.S. PATENT DOCUMENTS

| | | | |
|---|---|---|---|
| 211,076 | 12/1878 | Follett | 220/23.87 |
| 1,136,235 | 4/1915 | Jones | 220/23.87 |
| 2,906,061 | 9/1959 | Carlson | 220/475 |
| 4,491,232 | 1/1985 | Hansen | 220/475 |
| 4,572,400 | 2/1986 | Sosa | 220/908 |
| 5,183,175 | 2/1993 | Brown | 220/908 |

*Primary Examiner*—Stephen Castellano
*Attorney, Agent, or Firm*—Robert M. Downey, P. A.

[57] ABSTRACT

A trash receptacle assembly for installation on a support surface includes an outer housing formed and configured in the shape of a golf bag and including a base mounted to the support surface, a main body and an open top. A container includes a bottom wall, a top rim surrounding an open mouth, and a side wall structure extending between the bottom wall and the open mouth in surrounding relation to a trash chamber, the container being structured and disposed for removable receipt through the open top of the housing so that the top rim engages an upper end of the housing body to support the container within an interior of the housing. Drainage openings in the container and housing facilitate draining of liquid therefrom. The main body of the housing includes at least one area on an exterior surface for displaying an advertisement or message.

8 Claims, 1 Drawing Sheet

TRASH RECEPTACLE WITH ADVERTISEMENT DISPLAY

BACKGROUND OF THE INVENTION

1. Field of the Invention

The present invention relates to trash receptacles and, more particularly, to a trash receptacle assembly having an outer housing and a trash container sized and configured for removable receipt and support within the housing.

2. Discussion of the Related Art

Trash receptacles of various design are well known and used at virtually every public and private facility to provide a convenient means for people to dispose of unwanted articles of trash, including disposable cups, beverage cans, food containers and wrappers, and the like. Often, trash articles such as these still contain liquid or food when they are deposited in the trash can. It is, therefore, necessary to wash trash receptacles on a regular basis, after dumping the garbage contained therein.

Proper placement and maintenance of trash receptacles throughout a facility, such as a park or golf course, can help to minimize litter and damage to the environment, thereby maintaining the beauty and cleanliness of the facility. However, those which are commonly known and used at beaches, parks, golf courses, and the like are generally unattractive, and some are even unsightly. For instance, a great number of trash receptacles are constructed of wire or metal strips which are woven in a chain link type structure, leaving large openings about the sides of the trash can. This structure not only fails to hold the trash, especially smaller articles which tend to fall out through the openings, but it also causes the trash contained in the receptacle to be visibly exposed through the sides.

Other trash receptacles known in the art are made to be more attractive by providing a cabinet structure or decorative facing about the trash can. While this helps to enhance the appearance, by hiding the trash can, structures of this nature are typically difficult to clean and maintain. More specifically, the garbage deposited in trash cans sometimes overflows or spills from the can, especially if it is not emptied in a timely manner. If the can is contained within a cabinet structure, the garbage spills out into the cabinet interior surrounding the can. And, because trash can cabinets typically do not provide drainage means, rinsing of the interior with a hose is not practical.

In summary, the trash collecting assemblies known in the art are all generally limited in appearance and purpose, specifically for holding trash. Further, most of the trash cans in the related art are difficult to empty and wash in order to clean out spilled beverages and food.

SUMMARY OF THE INVENTION

The present invention is directed to a trash receptacle assembly for installation on a support surface, such as a cement slab. In one embodiment, the trash receptacle assembly is particularly suited for use on a golf course and includes an outer housing formed and configured in the shape of a golf bag. The outer housing includes a base mounted to the support surfaces a main body, and an open top. A trash container is structured for removable receipt through the open top of the housing and includes a bottom wall, a top rim surrounding an open mouth, and a side wall structure extending between the bottom wall and the open mouth in surrounding relation to a trash receiving chamber. When received within the housing, the top rim of the trash container engages an upper end of the housing body to support the trash container within the housing interior so that the open mouth is maintained at the top of the housing. Drainage openings in the container and housing facilitate draining of liquid therefrom. Accordingly, liquid beverages which spill in the trash container will be drained from the container and housing. Further, after emptying the trash containers both the container and housing interior can be rinsed with a hose to clean the entire assembly. The main body of the housing further includes at least one area on an exterior surface for displaying an advertisement or message, such as the trademark of a sponsor.

With the foregoing in mind, it is a primary object of the present invention to provide a trash receptacle assembly including an attractive housing with means for displaying a message or advertisement and a trash container sized and configured for easy placement and removal from a supported position within the housing.

It is a further object of the present invention to provide a trash receptacle assembly which is easy to clean and maintain.

It is still a further object of the present invention to provide a trash receptacle assembly including an attractive housing and a trash container adapted to be easily placed and removed from within the housings and wherein both the trash container and housing include drainage means to drain liquid therefrom.

It is still a further object of the present invention to provide a trash receptacle assembly including a housing formed and configured in the shape of a golf bag and a trash container adapted to be easily placed and removed from within the housing, wherein the trash receptacle assembly is ideal for installation at select areas (e.g., the tee area) throughout a golf course.

It is yet a further object of the present invention to provide a trash receptacle assembly which is highly attractive in appearances easy to clean and maintains and which provides an ideal display surface area for placement of an advertisements message, or other indicia.

These and other objects of the present invention will be more readily apparent in the description which follows taken in conjunction with the accompanying drawings.

BRIEF DESCRIPTION OF THE DRAWINGS

For a fuller understanding of the nature of the present invention, reference should be made to the accompanying drawings taken in conjunction with the detailed description in which.

Like reference numerals refer to like parts throughout the several views of the drawings.

DETAILED DESCRIPTION OF THE PREFERRED EMBODIMENT

Figure 1:
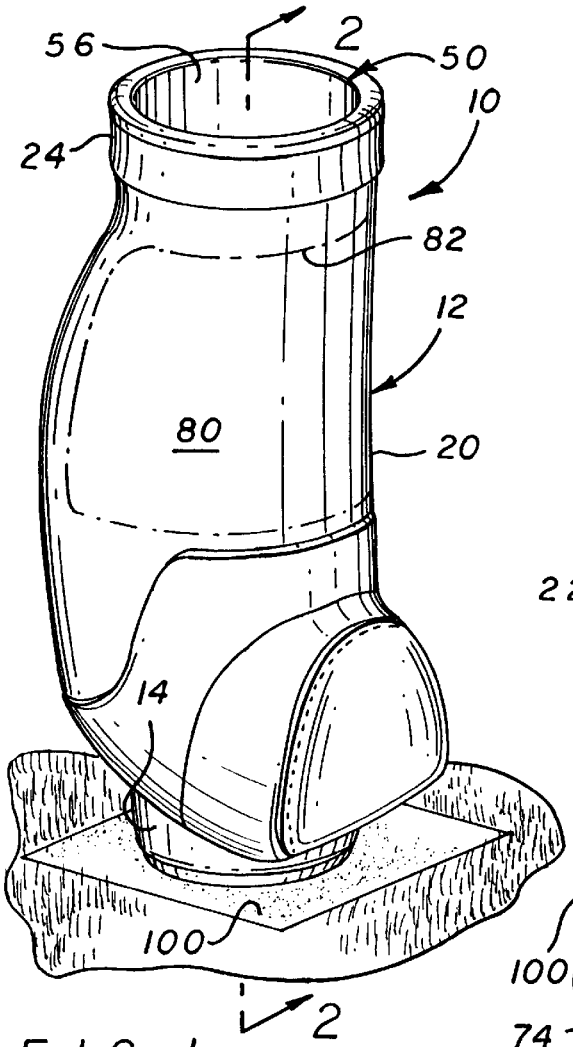
FIG. 1 is a front, top perspective view of the trash receptacle assembly of the present invention shown installed on a cement slab.

The trash receptacle assembly is generally indicated as 10 throughout the several views of the drawings, and includes a housing 12 molded of a plastic material or fiberglass. In the preferred embodiment, the housing 12 is formed and configured in the shape of a golf bag. The housing 12 includes a base 14 having a floor 16 which rests on a support surface 100. A main body 20 extends from the base 14 to an upper end 24 to define an exterior wall structure of the assembly 10. The main body 20 surrounds a hollow interior chamber 22 of the housing 12. The interior chamber 22 is open at a top 26 which is surrounded by the upper end 24 of the housing 12. In the preferred embodiment, the upper end 24 includes an inwardly directed annular lip 28 about the open top 26. A shoulder 30 is provided on an upper surface of the lip 28, outboard of a vertical reinforcing ridge 32.

Figure 2:
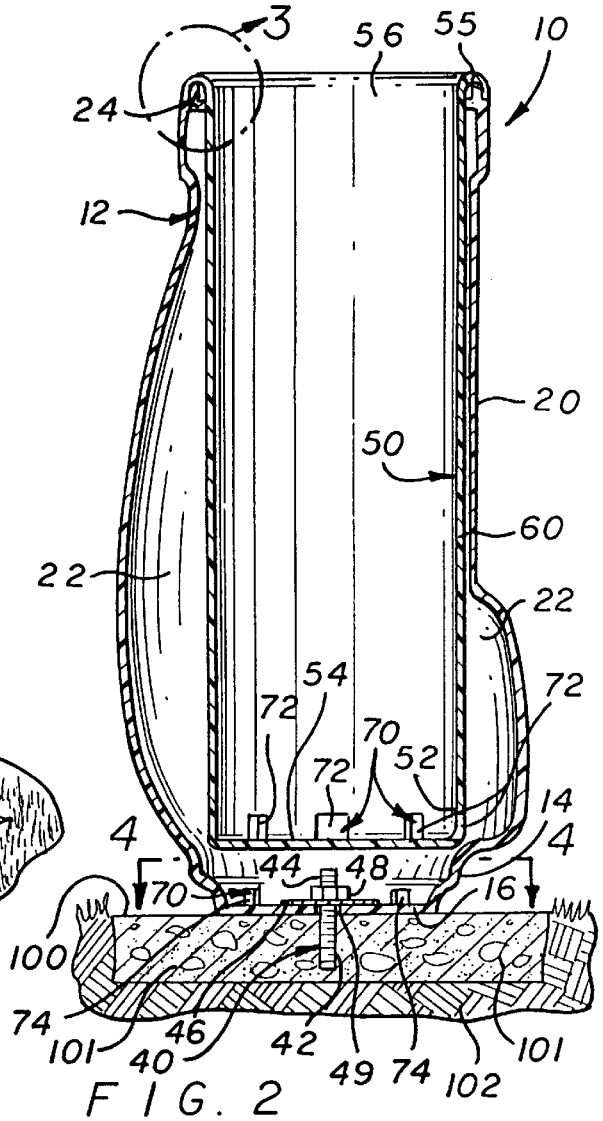
FIG. 2 is a elevational view, in cross section, taken along the plane indicated by the line 2—2 of FIG. 1.

In use, the trash receptacle assembly 10 is installed on the ground surface 100 preferably on a cement slab, in a generally upright, vertical position as seen in FIGS. 1 and 2. It is contemplated that the trash receptacle assembly 10 will be installed at various select locations throughout a golf course. In particular, the tee area of each hole on the golf course is believed to be an ideal installation site. In this instance, a cement slab 101 may be poured in the ground 102 as seen in FIGS. 1 and 2, next to the tee area.

To secure the assembly 10 on the support surface 100 mounting means 40 is provided. In a preferred embodiment, the mounting means 40 includes a stainless steel or aluminum shaft 42 of approximately 6" to 8" in length. A lower portion of the shaft 42 is embedded within the cement slab 101 so that an upper portion 44 of approximately 4" in length remains extending vertically from the slab 101, above the support surface 100. The upper portion 44 of the shaft 42 is threaded to receive a nut 48. To install the assembly 10, the floor 14 of the housing 12 is lowered onto the support surface 100 so that the upper distal end of the shaft 44 is received through a central hole 49 formed through the floor 14 so that the upper end 44 of the shaft 42 is positioned within the interior chamber 22 at the base 14. A plate or washer 46 is received on the upper end 44 of the shaft 42 so that it rests on the floor 14 within the interior 22 of the housing 12. Thereafter, the nut 48 is threadably advanced on the shaft 42 towards the plate 46 and is tightened to press the plate 46 firmly against the floor 14 so that the floor is squeezed in sandwiched relation between the support surface 100 and the plate 46.

Trash container 50 is structured, sized and configured for passage through the open top 26 of the housing 12 so that the trash container 50 may be received and supported within the interior chamber 22. Like the housing 12, the trash container 50 is formed of a plastic material or fiberglass and includes a lower end zone 52 with a bottom wall 54, a top rim 55D and a side wall structure 60. The top rim 55 surrounds an open mouth 56 and is curved outwardly and downwardly, terminating at a free edge 58. When fully received within the interior 22 of the housing 12, the free edge 58 rests on the shoulder 30 to support the trash container 50 in operable position with bottom wall 54 of the trash container 50 disposed in spaced relation above the floor 14 and the top end of the shaft 42D as seen in FIG. 2. In this supported positions the open mouth 56 of the trash container 50 is maintained at the top of the housing 12D at generally the same level as the upper end 24.

Figure 4:
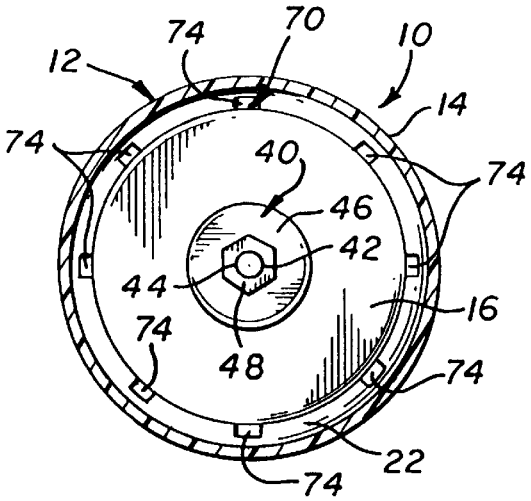
FIG. 4 is a top plan view, in cross section, taken along the plane indicated by the line 4—4 of FIG. 2.
Figure 3:
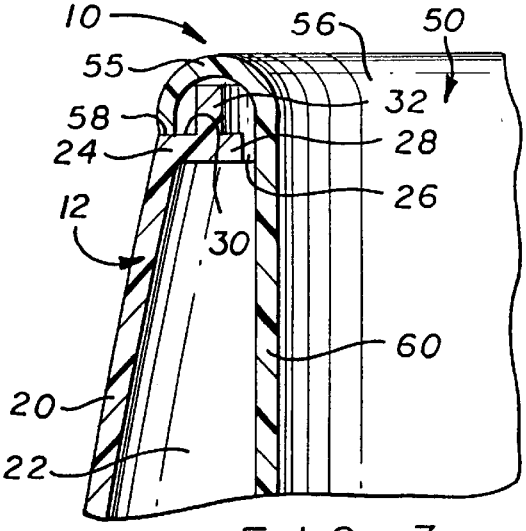
FIG. 3 is an isolated view of the trash container support structure, taken from the area indicated as 3 in FIG. 2.

Drainage means 70 is provided for draining liquid from the interior of the assembly 10. Specifically, the lower end zone 52 of the trash container 50 is provided with a plurality of holes or openings 72 about the side wall structure 60 adjacent the bottom wall 54. Further, the base 14 of the housing 12 is provided with holes or openings 74, as seen in FIGS. 2 and 4. The drainage means 70 allows liquid beverages which spill from cups, bottles, cans, and the like to drain from the trash container 50 and housing 12. Specifically, liquids which settle to the bottom 54 of the trash container will naturally flow out through the openings 72 into the base 14 within the interior 22 of the housing. Thereafter, the liquid flows out through the openings 74 onto the ground surface 100 exterior of the assembly 10. The drainage means 70 also permits water and cleaning solutions to easily drain from the trash container 50 and housing 12 when washing the assembly 10. In this manner, the interior surfaces of the trash container 50 and housing 12 can be rinsed with a hose (with or without a cleaning solution) and left to dry as the liquid drains by gravity through the openings 72, 74.

The housing 12 may also be used to display messages, advertisements, or other indicia. Specifically, the exterior surface of the housing 12 is provided with a surface area 80 which is indicated by the surrounding broken line 82 in FIG. 1. In one particular embodiment of the present invention, wherein the assembly 10 is installed on a golf course, the surface area 80 may be used to display the trademark of, for instance, the sponsor of a golf tournament. Alternatively, the surface area 80 may be sold or leased as advertising space, much like a billboard.

While the present invention has been shown and described in what is considered to be a preferred and practical embodiment thereof, it is recognized that departures may be made within the spirit and scope of the present invention which, therefore, should not be limited except as set forth in the following claims as interpreted under the doctrine of equivalents.

Now that the invention has been described,

What is claimed is:

1. A trash receptacle assembly for installation on a support surface comprising:

a housing formed and configured in the shape of a golf bag and including a base having a floor, a main body surrounding an interior chamber and an upper end surrounding an open top of said interior chamber, mounting means for anchoring said housing to the support surface in an upright position so that said upper end is disposed above said base, a container including a lower end zone with a bottom wall, a top rim surrounding an open mouth, and a side wall structure extending between said lower end zone and said open mouth in surrounding relation to a trash chamber communicating with said open mouth, said container being structured and disposed for removable receipt through said open top and within said interior chamber of said housing, means for supporting said container within said interior chamber of said housing, and said mounting means including:

an aperture formed through said floor of said housing;

a shaft having a first end zone anchored within said support surface and an opposite threaded distal end zone sized for receipt through said aperture and into said interior chamber, below said bottom wall of said container supported therein;

plate means adapted for receipt on said shaft and for engaging said floor of said housing, and a fastening element structured for threaded receipt and advancement on said threaded distal end zone of said shaft to force said plate means against said floor, thereby securing said base to the support surface.

2. An assembly as recited in claim 1 further including drainage means for draining liquid from said trash chamber of said container.

3. An assembly as recited in claim 2 wherein said drainage means is further structured to drain liquid from said interior chamber of said housing.

4. An assembly as recited in claim 3 wherein said top rim is curled outwardly and downwardly relative to said open mouth.

5. An assembly as recited in claim 4 wherein said upper end of said housing includes shoulder means for supporting engagement with said top rim.

6. An assembly as recited in claim 5 wherein said means for supporting said container within said interior chamber of said housing is defined by the combination of said top rim and said shoulder means.

7. An assembly as recited in claim 2 wherein said drainage means includes a plurality of openings formed through said lower end zone of said container.

8. An assembly as recited in claim 7 wherein said drainage means further includes a plurality of openings formed through said base.

* * * * *